US009494293B2

(12) United States Patent
Pickard

(10) Patent No.: US 9,494,293 B2
(45) Date of Patent: Nov. 15, 2016

(54) TROFFER-STYLE OPTICAL ASSEMBLY

(75) Inventor: Paul Kenneth Pickard, Morrisville, NC (US)

(73) Assignee: CREE, INC., Durham, NC (US)

( * ) Notice: Subject to any disclaimer, the term of this patent is extended or adjusted under 35 U.S.C. 154(b) by 165 days.

(21) Appl. No.: 12/961,385

(22) Filed: Dec. 6, 2010

(65) Prior Publication Data

US 2012/0140461 A1 Jun. 7, 2012

(51) Int. Cl.

| | |
|---|---|
| ***F21V 5/04*** | (2006.01) |
| ***F21V 15/01*** | (2006.01) |
| ***F21V 7/00*** | (2006.01) |

(Continued)

(52) U.S. Cl.

CPC .. *F21V 5/04* (2013.01); *F21S 4/20* (2016.01); *F21V 7/005* (2013.01); *F21V 7/0091* (2013.01); *F21V 15/013* (2013.01); *F21V 29/505* (2015.01); *F21V 29/745* (2015.01); *F21V 29/75* (2015.01); *F21V 29/777* (2015.01); *F21K 9/52* (2013.01); *F21Y 2101/02* (2013.01); *F21Y 2105/001* (2013.01); *F21Y 2113/005* (2013.01)

(58) Field of Classification Search

CPC ..... F21V 5/04; F21V 29/777; F21V 29/745; F21V 29/75; F21V 29/505; F21V 7/005; F21V 7/0091; F21V 15/013; F21S 4/003; F21Y 2113/005; F21Y 2105/001; F21Y 2101/02; F21K 9/52

USPC ..... 362/225, 222, 223, 224, 217.01, 219, 362/221, 217.02, 217.04, 217.05, 217.1, 362/217.11, 217.12, 230, 231, 249.01, 362/249.02, 310, 334, 335

See application file for complete search history.

(56) References Cited

U.S. PATENT DOCUMENTS

| | | | | |
|---|---|---|---|---|
| D85,382 | S | 10/1931 | Guth | D26/24 |
| 2,356,654 | A | 8/1944 | Cullman | 200/84 C |

(Continued)

FOREIGN PATENT DOCUMENTS

| | | |
|---|---|---|
| CN | 1762061 | 4/2006 |
| CN | 1934389 | 3/2007 |

(Continued)

OTHER PUBLICATIONS

Notice to Submit a Response from Korean Patent Application No. 30-2011-0038115. dated Dec. 12, 2012.

(Continued)

*Primary Examiner* — Stephen F Husar
*Assistant Examiner* — Danielle Allen
(74) *Attorney, Agent, or Firm* — Koppel, Patrick, Heybl & Philpott

(57) ABSTRACT

A troffer-style fixture. The fixture is particularly well-suited for use with solid state light sources. The troffer comprises a light engine unit surrounded by a reflective pan. An elongated heat sink comprises a mount surface for light sources. An elongated lens is mounted on or above the heat sink. The mount surface is designed to accommodate the light emitters which may come on prefabricated a light strip. One or more reflectors extend out away from the heat sink on the mount surface side. A lens plate is mounted to proximate to the heat sink and extends out to the edge of the reflector(s). An interior cavity is at least partially defined by the reflector(s), the lens plates, and the heat sink. One or more light sources disposed along the heat sink mount surface emit light into the interior cavity where it can be mixed and/or shaped before it is emitted.

75 Claims, 5 Drawing Sheets

(51) Int. Cl.

| | |
|---|---|
| ***F21V 29/505*** | (2015.01) |
| ***F21V 29/74*** | (2015.01) |
| ***F21V 29/75*** | (2015.01) |
| ***F21V 29/77*** | (2015.01) |
| *F21K 99/00* | (2016.01) |
| *F21Y 101/02* | (2006.01) |
| *F21Y 105/00* | (2016.01) |
| *F21Y 113/00* | (2016.01) |

(56) References Cited

U.S. PATENT DOCUMENTS

| | | | | |
|---|---|---|---|---|
| 3,381,124 | A | 4/1968 | Eisenberg | 362/354 |
| 4,939,627 | A | 7/1990 | Herst et al. | 362/299 |
| 5,025,356 | A | 6/1991 | Gawad | 362/221 |
| 5,526,190 | A | 6/1996 | Hubble, III | 347/102 |
| 5,823,663 | A | 10/1998 | Bell et al. | 362/362 |
| D407,473 | S | 3/1999 | Wimbock | D23/328 |
| 6,149,283 | A | 11/2000 | Conway et al. | 362/236 |
| 6,155,699 | A * | 12/2000 | Miller et al. | 362/293 |
| 6,210,025 | B1 | 4/2001 | Schmidt et al. | 362/362 |
| 6,234,643 | B1 | 5/2001 | Lichon, Jr. | 362/147 |
| 6,402,347 | B1 | 6/2002 | Maas et al. | 362/294 |
| 6,443,598 | B1 | 9/2002 | Morgan | 362/342 |
| 6,523,974 | B2 | 2/2003 | Engel | 362/224 |
| 6,578,979 | B2 | 6/2003 | Truttmann-Battig | 362/92 |
| 6,598,998 | B2 | 7/2003 | West | 257/533.073 |
| D496,121 | S | 9/2004 | Santoro | D26/74 |
| 6,871,983 | B2 | 3/2005 | Jacob et al. | 362/364 |
| 6,948,838 | B2 | 9/2005 | Kunstler | 362/237 |
| 6,948,840 | B2 | 9/2005 | Grenda et al. | 362/555 |
| 6,951,415 | B2 | 10/2005 | Amano | 362/297 |
| 7,021,797 | B2 | 4/2006 | Minano et al. | 362/355 |
| 7,049,761 | B2 | 5/2006 | Timmermans et al. | 315/246 |
| 7,063,449 | B2 | 6/2006 | Ward | 345/102 |
| 7,111,969 | B2 | 9/2006 | Bottesch | 362/299 |
| 7,175,296 | B2 | 2/2007 | Cok | 362/147 |
| 7,213,940 | B1 | 5/2007 | Van de Ven et al. | 362/231 |
| 7,217,004 | B2 | 5/2007 | Park | 362/240 |
| 7,237,924 | B2 | 7/2007 | Martineau et al. | 362/231 |
| D556,358 | S | 11/2007 | Santoro | D26/74 |
| 7,338,182 | B1 | 3/2008 | Hastings et al. | 362/150 |
| 7,341,358 | B2 | 3/2008 | Hsieh | 362/97.1 |
| 7,510,299 | B2 | 3/2009 | Timmermans et al. | 362/225 |
| 7,520,636 | B2 | 4/2009 | Van der Poel | 362/290 |
| D593,246 | S | 5/2009 | Fowler et al. | D26/76 |
| 7,559,672 | B1 | 7/2009 | Parkyn et al. | 362/244 |
| 7,594,736 | B1 * | 9/2009 | Kassay et al. | 362/225 |
| D604,446 | S | 11/2009 | Fowler et al. | D26/76 |
| 7,618,157 | B1 | 11/2009 | Galvez et al. | 362/294 |
| 7,618,160 | B2 | 11/2009 | Chinniah et al. | 362/326 |
| D608,932 | S | 1/2010 | Castelli | D26/76 |
| 7,654,702 | B1 | 2/2010 | Ding et al. | 362/294 |
| 7,661,844 | B2 * | 2/2010 | Sekiguchi et al. | 362/249.02 |
| D611,183 | S | 3/2010 | Duarte | D26/76 |
| 7,674,005 | B2 | 3/2010 | Chung et al. | 362/223 |
| 7,686,470 | B2 | 3/2010 | Chiang | 362/147 |
| 7,686,484 | B2 | 3/2010 | Heiking et al. | 362/375 |
| 7,712,918 | B2 | 5/2010 | Siemiet et al. | 362/241 |
| 7,722,220 | B2 | 5/2010 | Van de Ven | 362/294 |
| 7,722,227 | B2 | 5/2010 | Zhang et al. | 362/364 |
| D617,487 | S | 6/2010 | Fowler et al. | D26/76 |
| 7,768,192 | B2 | 8/2010 | Van de Ven et al. | 313/503 |
| 7,815,338 | B2 | 10/2010 | Siemiet et al. | 362/218 |
| 7,824,056 | B2 | 11/2010 | Madireddi et al. | 362/125 |
| 7,828,468 | B2 | 11/2010 | Mayfield et al. | 362/342 |
| D633,247 | S | 2/2011 | Kong et al. | D26/88 |
| 7,922,354 | B2 | 4/2011 | Everhart | 362/235 |
| 7,926,982 | B2 | 4/2011 | Liu | 362/294 |
| 7,988,321 | B2 | 8/2011 | Wung et al. | 362/218 |
| 7,988,335 | B2 * | 8/2011 | Liu et al. | 362/294 |
| 7,991,257 | B1 | 8/2011 | Coleman | |
| 7,993,034 | B2 | 8/2011 | Wegner | 362/296.05 |
| 7,997,762 | B2 | 8/2011 | Wang et al. | 362/249 |
| 8,038,314 | B2 | 10/2011 | Ladewig | |
| 8,038,321 | B1 | 10/2011 | Franck et al. | 362/249.02 |
| 8,070,326 | B2 | 12/2011 | Lee | 362/307 |
| D653,376 | S | 1/2012 | Kong et al. | D26/76 |
| 8,092,043 | B2 | 1/2012 | Lin et al. | 362/249.02 |
| 8,092,049 | B2 | 1/2012 | Kinnune et al. | 362/294 |
| 8,096,671 | B1 | 1/2012 | Cronk | 362/147 |
| D657,488 | S | 4/2012 | Lown et al. | D26/120 |
| 8,162,504 | B2 | 4/2012 | Zhang et al. | 362/217 |
| 8,186,855 | B2 | 5/2012 | Wassel et al. | 362/373 |
| 8,197,086 | B2 | 6/2012 | Watanabe et al. | 362/218 |
| 8,201,968 | B2 | 6/2012 | Maxik et al. | |
| 8,215,799 | B2 | 7/2012 | Vanden Eynden et al. | 362/294 |
| 8,246,219 | B2 | 8/2012 | Teng | 362/217.02 |
| 8,256,927 | B2 | 9/2012 | Hu | 362/218 |
| D670,849 | S | 11/2012 | Lay et al. | D26/74 |
| 8,317,354 | B2 | 11/2012 | Gassner et al. | 362/147 |
| D679,848 | S | 4/2013 | Pickard et al. | D26/74 |
| 8,410,514 | B2 | 4/2013 | Kim | 257/99 |
| D684,291 | S | 6/2013 | Goelz et al. | D26/74 |
| 8,480,252 | B2 | 7/2013 | Bertram et al. | 362/243 |
| 8,506,135 | B1 | 8/2013 | Oster | 362/373 |
| 8,556,452 | B2 | 10/2013 | Simon | 362/217.07 |
| 8,591,058 | B2 | 11/2013 | Concepcion | 362/231 |
| 8,591,071 | B2 | 11/2013 | Hochstein | 362/294 |
| 8,602,601 | B2 | 12/2013 | Khazi | 362/249.02 |
| 8,616,723 | B2 | 12/2013 | Zhang | 362/218 |
| D698,975 | S | 2/2014 | Blessit et al. | D26/74 |
| 8,641,243 | B1 | 2/2014 | Rashidi | 362/373 |
| D701,988 | S | 4/2014 | Clements | D26/74 |
| 8,696,154 | B2 | 4/2014 | Hutchens | 362/217.05 |
| 8,702,264 | B1 | 4/2014 | Rashidi | 362/147 |
| 8,764,244 | B2 | 7/2014 | Jeon | 362/218 |
| D714,988 | S | 10/2014 | Park et al. | D26/74 |
| D721,198 | S | 1/2015 | Glasbrenner | D26/76 |
| 9,052,075 | B2 | 6/2015 | Demuynck et al. | |
| 2003/0063476 | A1 | 4/2003 | English et al. | |
| 2004/0001344 | A1 | 1/2004 | Hecht | 362/555 |
| 2004/0085779 | A1 | 5/2004 | Pond et al. | 362/516 |
| 2004/0100796 | A1 | 5/2004 | Ward | |
| 2004/0240230 | A1 | 12/2004 | Kitajima | 362/558 |
| 2005/0180135 | A1 | 8/2005 | Mayer | 362/240 |
| 2005/0264716 | A1 | 12/2005 | Kim et al. | |
| 2005/0281023 | A1 | 12/2005 | Gould | 362/217 |
| 2006/0221611 | A1 | 10/2006 | No | 362/247 |
| 2006/0262521 | A1 | 11/2006 | Piepgras et al. | 362/149 |
| 2006/0291206 | A1 | 12/2006 | Angelini et al. | 362/244 |
| 2007/0070625 | A1 | 3/2007 | Bang | 362/240 |
| 2007/0109779 | A1 | 5/2007 | Sekiguchi et al. | |
| 2007/0115670 | A1 | 5/2007 | Roberts et al. | |
| 2007/0115671 | A1 | 5/2007 | Roberts et al. | |
| 2007/0211457 | A1 | 9/2007 | Mayfield et al. | 362/223 |
| 2007/0253205 | A1 | 11/2007 | Welker | 362/373 |
| 2007/0297181 | A1 | 12/2007 | Mayfield et al. | 362/342 |
| 2008/0019147 | A1 | 1/2008 | Erchak | 362/607 |
| 2008/0049422 | A1 | 2/2008 | Trenchard et al. | 362/238 |
| 2008/0232093 | A1 | 9/2008 | Kim | 362/147 |
| 2008/0278943 | A1 | 11/2008 | Van Der Poel | 362/240 |
| 2009/0034247 | A1 | 2/2009 | Boyer | 362/225 |
| 2009/0073693 | A1 | 3/2009 | Nall | 362/249.02 |
| 2009/0161356 | A1 | 6/2009 | Negley et al. | 362/231 |
| 2009/0168439 | A1 | 7/2009 | Chiang | 362/404 |
| 2009/0196024 | A1 | 8/2009 | Heiking et al. | 362/150 |
| 2009/0237958 | A1 | 9/2009 | Kim | |
| 2009/0262543 | A1 | 10/2009 | Ho | 362/373 |
| 2009/0296388 | A1 | 12/2009 | Wu et al. | 362/235 |
| 2009/0310354 | A1 * | 12/2009 | Zampini et al. | 362/235 |
| 2009/0323334 | A1 | 12/2009 | Roberts et al. | |
| 2010/0061108 | A1 | 3/2010 | Zhang et al. | 362/364 |
| 2010/0097794 | A1 | 4/2010 | Teng et al. | 362/231 |
| 2010/0103678 | A1 | 4/2010 | Van de Ven et al. | 362/294 |
| 2010/0110679 | A1 | 5/2010 | Teng et al. | |
| 2010/0172133 | A1 * | 7/2010 | Liu | 362/235 |
| 2010/0177532 | A1 | 7/2010 | Simon et al. | |
| 2010/0188609 | A1 | 7/2010 | Matsuki et al. | |
| 2010/0253591 | A1 | 10/2010 | Hwu et al. | 345/1.3 |
| 2010/0254128 | A1 | 10/2010 | Pickard et al. | 362/231 |
| 2010/0254145 | A1 | 10/2010 | Yamaguchi | |
| 2010/0254146 | A1 | 10/2010 | McCanless | |
| 2010/0270903 | A1 | 10/2010 | Jao et al. | 313/46 |

(56) References Cited

U.S. PATENT DOCUMENTS

| | | | | |
|---|---|---|---|---|
| 2010/0271843 | A1 | 10/2010 | Holten et al. | 362/609 |
| 2010/0277905 | A1 | 11/2010 | Janik et al. | 362/235 |
| 2010/0277934 | A1 | 11/2010 | Oquendo, Jr. | 362/433 |
| 2010/0295468 | A1 | 11/2010 | Pederson et al. | 315/294 |
| 2010/0327768 | A1 | 12/2010 | Kong et al. | 315/294 |
| 2011/0032714 | A1 | 2/2011 | Chang | 362/373 |
| 2011/0043132 | A1 | 2/2011 | Kim et al. | 362/235 |
| 2011/0090671 | A1 | 4/2011 | Bertram et al. | 362/84 |
| 2011/0141722 | A1 | 6/2011 | Acampora et al. | 362/218 |
| 2011/0141734 | A1* | 6/2011 | Li et al. | 362/235 |
| 2011/0156584 | A1 | 6/2011 | Kim | 315/32 |
| 2011/0164417 | A1 | 7/2011 | Huang | 362/235 |
| 2011/0175533 | A1 | 7/2011 | Homan | 315/130 |
| 2011/0199005 | A1 | 8/2011 | Bretschneider et al. | |
| 2011/0199769 | A1 | 8/2011 | Bretschneider et al. | |
| 2011/0246146 | A1 | 10/2011 | Kauffman et al. | 703/2 |
| 2011/0255292 | A1 | 10/2011 | Shen | 362/311 |
| 2011/0267810 | A1 | 11/2011 | Higman et al. | 362/218 |
| 2011/0267823 | A1 | 11/2011 | Angelini et al. | 362/277 |
| 2011/0305024 | A1 | 12/2011 | Chang | 362/294 |
| 2012/0038289 | A1 | 2/2012 | Jee et al. | 315/291 |
| 2012/0051041 | A1 | 3/2012 | Edmond et al. | 362/231 |
| 2012/0127714 | A1 | 5/2012 | Rehn | |
| 2012/0134146 | A1 | 5/2012 | Smith | 362/225 |
| 2012/0140442 | A1 | 6/2012 | Woo | 362/95 |
| 2012/0140461 | A1 | 6/2012 | Pickard | |
| 2013/0235568 | A1 | 9/2013 | Green et al. | 362/218 |
| 2013/0258652 | A1 | 10/2013 | Hsieh | 362/225 |
| 2014/0265930 | A1 | 9/2014 | Harris | 315/307 |
| 2015/0016100 | A1 | 1/2015 | Ishii | 362/223 |

FOREIGN PATENT DOCUMENTS

| | | | |
|---|---|---|---|
| CN | 1963289 | A | 5/2007 |
| CN | 101188261 | | 5/2008 |
| CN | 101660715 | | 3/2010 |
| CN | 101776254 | | 7/2010 |
| CN | 101790660 | | 7/2010 |
| CN | 101790660 | A | 7/2010 |
| CN | 102072443 | | 5/2011 |
| CN | 202580962 | | 12/2012 |
| DE | 102007030186 | | 1/2009 |
| DE | 202010001832 | | 7/2010 |
| EP | 1298383 | A2 | 4/2003 |
| EP | 1357335 | A2 | 10/2003 |
| EP | 1653254 | | 3/2006 |
| EP | 1737051 | | 12/2006 |
| EP | 1847762 | A2 | 10/2007 |
| EP | 1860467 | | 11/2007 |
| EP | 2287520 | A2 | 2/2011 |
| EP | 2290690 | A2 | 3/2011 |
| EP | 2636945 | A2 | 9/2013 |
| GB | 774198 | | 5/1957 |
| JP | 1069809 | | 3/1998 |
| JP | 2002244027 | | 11/2002 |
| JP | U3097327 | | 8/2003 |
| JP | 2004140327 | | 5/2004 |
| JP | 2004345615 | | 12/2004 |
| JP | 2004345615 | A | 12/2004 |
| JP | 2006173624 | | 6/2006 |
| JP | 2008147044 | | 6/2008 |
| JP | 3151501 | U | 6/2009 |
| JP | 2009295577 | | 12/2009 |
| JP | 2010103687 | | 5/2010 |
| JP | 2011018571 | | 8/2011 |
| JP | 2011018572 | | 8/2011 |
| TW | 200524186 | | 7/2005 |
| TW | 200524186 | A | 7/2005 |
| TW | 200914759 | A | 4/2009 |
| TW | 201018826 | | 5/2010 |
| TW | 201018826 | A | 5/2010 |
| WO | WO 03102467 | | 12/2003 |
| WO | WO 2009030233 | | 3/2009 |
| WO | WO 2009140761 | A1 | 11/2009 |
| WO | WO 2009157999 | | 12/2009 |
| WO | WO 2009157999 | A | 12/2009 |
| WO | WO 2009157999 | A1 | 12/2009 |
| WO | WO 2010024583 | | 3/2010 |
| WO | WO 2010024583 | A2 | 3/2010 |
| WO | WO 2010042216 | | 4/2010 |
| WO | WO 2010042216 | A2 | 4/2010 |
| WO | WO 2011074424 | A1 | 6/2011 |
| WO | WO 2011096098 | A1 | 8/2011 |
| WO | WO 2011098191 | | 8/2011 |
| WO | WO 2011118991 | A2 | 9/2011 |
| WO | WO 2011140353 | A2 | 11/2011 |

OTHER PUBLICATIONS

Notice to Submit a Response from Korean Patent Application No. 30-2011-0038116. dated Dec. 12, 2012.

Search Report and Written Opinion from PCT Patent Appl. No. PCT/US2012/047084, dated Feb. 27, 2013.

Search Report and Written Opinion from PCT Patent Appl. No. PCT/US2012/071800, dated Mar. 25, 2013.

International Search Report and Written Opinion for Patent Application No. PCT/US2011/001517, dated: Feb. 27, 2012.

Office Action from Japanese Design Patent Application No. 2011-18570.

Reason for Rejection from Japanese Design Patent Application No. 2011-18571.

Reason for Rejection from Japanese Design Patent Application No. 2011-18572.

International Search Report and Written Opinion for PCT Application No. PCT/US2011/062396, dated Jul. 13, 2012.

Final Rejection issued in Korean Design Appl. No. 30-2011-0038114, dated Jun. 14, 2013.

Final Rejection issued in Korean Design Appl. No. 30-2011-0036115, dated Jun. 14, 2013.

Final Rejection issued in Korean Design Appl. No. 30-2011-0038116, dated Jun. 17, 2013.

International Search Report and Written Opinion from PCT Patent Appl. No. PCT/US2013/035668, dated Jul. 12, 2013.

International Search Report and Written Opinion from PCT Application No. PCT/US2013/021053, dated Apr. 17, 2013.

International Preliminary Report on Patentabiliby from PCT/US2012/071800 dated Jul. 10, 2014.

Office Action from U.S. Appl. No. 13/189,535, dated Jun. 20, 2014.

Office Action from U.S. Appl. No. 13/453,924. dated Jun. 25, 2014.

Office Action from U.S. Appl. No. 13/443,630. dated Jul. 1, 2014.

Reasons for Rejection from Japanese Patent Appl. No. 2013-543207, dated May 20, 2014.

First Office Action from Chinese Patent Appl. No. 2011800529984, dated May 4, 2014.

Office Action from U.S. Appl. No. 13/544,662, dated May 5, 2014.

Office Action from U.S. Appl. No. 13/844,431, dated May 15, 2014.

Office Action from U.S. Appl. No. 13/341,741, dated Jun. 6, 2014.

Office Action from U.S. Appl. No. 13/464,745, dated Feb. 12, 2014.

Office Action from U.S. Appl. No. 13/453,924, dated Feb. 19, 2014.

Office Action from U.S. Appl. No. 13/341,741, dated Jan. 14, 2014.

Office Action from U.S. Appl. No. 13/370,252, dated Dec. 20, 2013.

Office Action from U.S. Appl. No. 13/429,080, dated Apr. 18, 2014.

Office Action from U.S. Appl. No. 13/464,745, dated Jul. 16, 2014.

International Preliminary Report on Patentability and Written Opinion from PCT/US2013/021053. dated Aug. 21, 2014.

Office Action from U.S. Appl. No. 29/387,171. dated May 2, 2012.

Response to OA from U.S. Appl. No. 29/387,171, filed Aug. 2, 2012.

Office Action from U.S. Appl. No. 13/464,745. dated Jul. 16, 2013.

Office Action from U.S. Appl. No. 29/368,970. dated Jun. 19, 2012.

Office Action from U.S. Appl. No. 29/368,970, dated Aug. 24, 2012.

Response to OA from U.S. Appl. No. 29/368,970, filed Nov. 26, 2012.

International Search Report and Written Opinion from Appl. No. PCT/CN2013/072772, dated Dec. 19, 2013.

International Search Report and Written Opinion from PCT/US2013/049225. dated Oct. 24, 2013.

(56) References Cited

OTHER PUBLICATIONS

Preliminary Report and Written Opinion from PCT appl. No. PCT/US2012/047084. dated Feb. 6, 2014.
Decision of Rejection from Japanese Appl. No. 2013-543207. dated Nov. 25, 2014.
Office Action from Mexican Appl. No. 100881, dated Nov. 28, 2014.
Grant Notice from European Appl. No. 13701525.1-1757. dated Nov. 24, 2014.
Preliminary Report on Patentability from PCT/US2013/035668. dated Oct. 14, 2014.
Office Action from U.S. Appl. No. 13/442,746, dated Sep. 15, 2014.
Office Action from U.S. Appl. No. 13/429,080, dated Sep. 16, 2014.
Office Action from U.S. Appl. No. 13/844,431, dated Oct. 10, 2014.
Office Action from U.S. Appl. No. 13/443,630, dated Oct. 10, 2014.
Office Action from U.S. Appl. No. 13/368,217, dated Oct. 22, 2014.
Office Action from U.S. Appl. No. 13/453,924, dated Nov. 7, 2014.
First Official Action from European Patent Appl. No. 12 743 003.1-1757, dated Jan. 16, 2015.
Office Action from U.S. Appl. No. 13/429,080, dated Sep. 1, 2015.
Office Action from U.S. Appl. No. 14/716,480, dated Sep. 24, 2015.
Office Action from U.S. Appl. No. 14/170,627, dated Oct. 5, 2015.
Office Action from U.S. Appl. No. 13/368,217, dated Oct. 8, 2015.
Office Action from U.S. Appl. No. 13/464,745, dated Oct. 8, 2015.
Office Action from U.S. Appl. No. 29/466,391, dated Oct. 14, 2015.
Second Office Action and Search Report from Chinese Appl. No. 2011800529984, dated Dec. 26, 2014.
Grant Notice from European Appl. No. 13701525.1, dated Nov. 19, 2014.
Office Action from U.S. Appl. No. 13/828,348, dated Nov. 20, 2014.
Office Action from U.S. Appl. No. 12/873,303, dated Nov. 28, 2014.
Office Action from U.S. Appl. No. 13/464,745, dated Dec. 10, 2014.
Office Action from U.S. Appl. No. 13/341,741, dated Dec. 24, 2014.
Office Action from U.S. Appl. No. 13/189,535, dated Jan. 13, 2015.
Office Action from U.S. Appl. No. 13/787,727, dated Jan. 29, 2015.
Office Action from U.S. Appl. No. 13/429,080, dated Feb. 18, 2015.
Office Action from U.S. Appl. No. 13/453,924, dated Mar. 10, 2015.
First Office Action from Chinese Patent Appl. No. 2012800369142, dated Mar. 26, 2015.
Office Action from U.S. Appl. No. 13/464,745, dated Apr. 2, 2015.
Office Action from U.S. Appl. No. 13/442,746, dated Apr. 28, 2015.
Office Action from U.S. Appl. No. 13/368,217. dated May 13, 2015.
Office Action from U.S. Appl. No. 13/828,348. dated May 27, 2015.
Communication from European Patent Appl. No. 13701525.1-1757, dated Sep. 26, 2014.
Notice of Completion of Pretrial Re-examination from Japanese Patent appl. No. 2013-543207, dated Jun. 30, 2015.
Pretrial Report from Japanese Appl. No. 2013-543207, dated Jun. 19, 2015.
Decision of Rejection from Chinese Patent Appl. No. 201180052998.4, dated Jul. 16, 2015.
Office Action from U.S. Appl. No. 12/873,303, dated Jun. 22, 2015.
Response to OA from U.S. Appl. No. 12/873,303, filed Aug. 21, 2015.
Office Action from U.S. Appl. No. 13/341,741, dated Jun. 22, 2015.
Office Action from U.S. Appl. No. 13/443,630, dated Jun. 23, 2015.
Response to OA from U.S. Appl. No. 13/443,630, filed Aug. 21, 2015.
Office Action from U.S. Appl. No. 13/189,535, dated Jul. 14, 2015.
Office Action from U.S. Appl. No. 13/453,924, dated Jul. 21, 2015.
Office Action from U.S. Appl. No. 13/442,746, dated Jul. 27, 2015.
Office Action from U.S. Appl. No. 14/020,757, dated Aug. 3, 2015.
Notice of Reasons for Rejection from Japanese Patent Appl. No. 2013-543207, dated Feb. 2, 2016.
Examination Report from Taiwanese Patent Appl. No. 100131021, dated Jan. 5, 2016.
Examination from European Patent Appl. No. 12743003.1-1757, dated Jan. 8, 2016.
Examination from European Patent Appl. No. 13 701 525.1-1757, dated Feb. 3, 2016.
Office Action from U.S. Appl. No. 13/189,535; Jan. 6, 2016.
Office Action from U.S. Appl. No. 13/341,741; Jan. 8, 2016.
Office Action from U.S. Appl. No. 13/873,303; Feb. 2, 2016.
Office Action from U.S. Appl. No. 13/464,745; Mar. 1, 2016.
Office Action from U.S. Appl. No. 14/716,480; Mar. 3, 2016.
Office Action from U.S. Appl. No. 13/368,217; Mar. 4, 2016.
Office Action from U.S. Appl. No. 13/189,535; Mar. 18, 2016.
Office Action from U.S. Appl. No. 14/020,757; Apr. 7, 2016.
Office Action from U.S. Appl. No. 29/466,391; May 10, 2016.
Second Office Action for Application No. 2011800588770; Dated Mar. 29, 2016.
Office Action from U.S. Appl. No. 13/828,348, dated Nov. 4, 2015.
Office Action from U.S. Appl. No. 14/020,757, dated Nov. 24, 2014.
First Office Action from Chinese Patent Appl. No. 2011800588770, dated Sep. 25, 2015.
Office Action for U.S. Appl. No. 13/828,348; Dated Jun. 2, 2016.
Notice of Reason for Rejection for Japanese Appl. No. 2013-543207; Dated May 24, 2016.
Office Action for U.S. Appl. No. 14/020,757; Dated Jul. 19, 2016.
Examination Report from Taiwan Application No. 100131021; Dated Jul. 21, 2016.
Office Action for U.S. Appl. No. 14/716,480; Dated Aug. 26, 2016.
European Summons for Oral Proceedings for Application No. 12743003.1; Dated Sep. 2, 2016.
Office Action for U.S. Appl. No. 13/464,745; Dated Sep. 7, 2016.

* cited by examiner

FIG. 5a
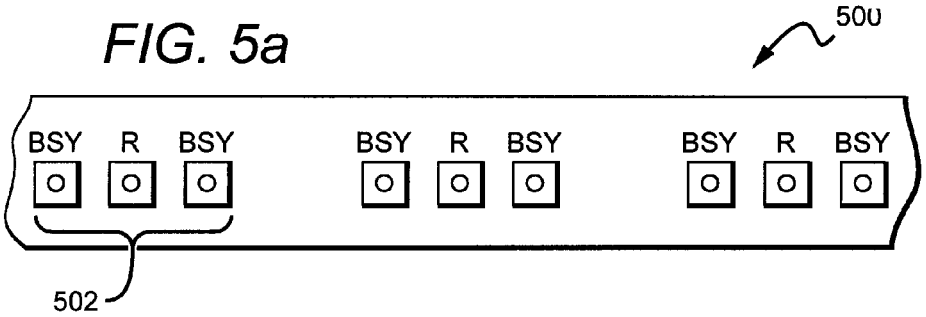
FIG. 5b
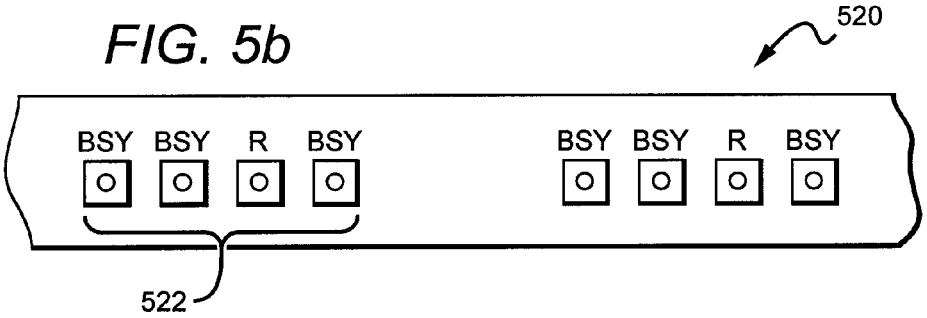
FIG. 5c
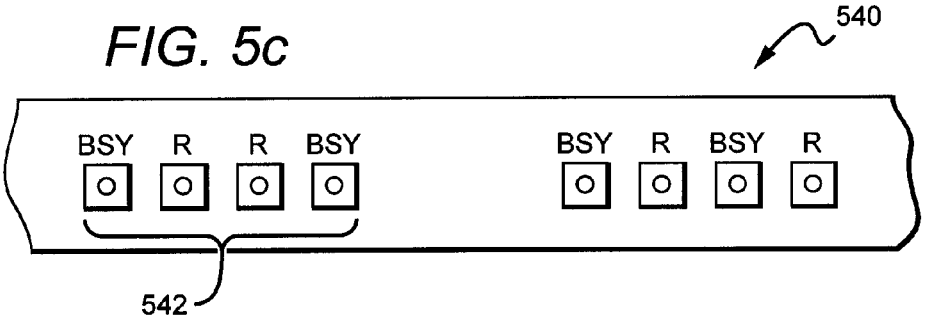
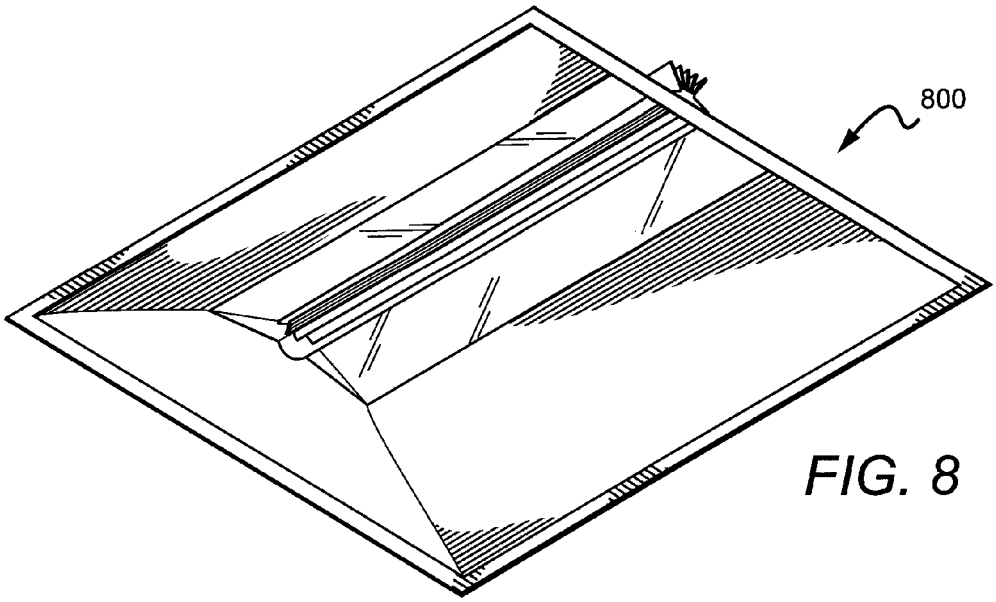
FIG. 8

TROFFER-STYLE OPTICAL ASSEMBLY

BACKGROUND OF THE INVENTION

Field of the Invention

The invention relates to troffer-style lighting fixtures and, more particularly, to troffer-style fixtures that are well-suited for use with solid state lighting sources, such as light emitting diodes (LEDs).

Description of the Related Art

Troffer-style fixtures are ubiquitous in commercial office and industrial spaces throughout the world. In many instances these troffers house elongated fluorescent light bulbs that span the length of the troffer. Troffers may be mounted to or suspended from ceilings. Often the troffer may be recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures.

More recently, with the advent of the efficient solid state lighting sources, these troffers have been used with LEDs, for example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

Other LED components or lamps have been developed that comprise an array of multiple LED packages mounted to a (PCB), substrate or submount. The array of LED packages can comprise groups of LED packages emitting different colors, and specular reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "downconverts" some of the blue light, changing it to yellow light. Some of the blue light passes through the phosphor without being changed while a substantial portion of the light is downconverted to yellow. The LED emits both blue and yellow light, which combine to yield white light.

In another known approach, light from a violet or ultraviolet emitting LED has been converted to white light by surrounding the LED with multicolor phosphors or dyes. Indeed, many other color combinations have been used to generate white light.

Because of the physical arrangement of the various source elements, multicolor sources often cast shadows with color separation and provide an output with poor color uniformity. For example, a source featuring blue and yellow sources may appear to have a blue tint when viewed head on and a yellow tint when viewed from the side. Thus, one challenge associated with multicolor light sources is good spatial color mixing over the entire range of viewing angles. One known approach to the problem of color mixing is to use a diffuser to scatter light from the various sources.

Another known method to improve color mixing is to reflect or bounce the light off of several surfaces before it is emitted from the lamp. This has the effect of disassociating the emitted light from its initial emission angle. Uniformity typically improves with an increasing number of bounces, but each bounce has an associated optical loss. Some applications use intermediate diffusion mechanisms (e.g., formed diffusers and textured lenses) to mix the various colors of light. Many of these devices are lossy and, thus, improve the color uniformity at the expense of the optical efficiency of the device.

Many current luminaire designs utilize forward-facing LED components with a specular reflector disposed behind the LEDs. One design challenge associated with multi-source luminaires is blending the light from LED sources within the luminaire so that the individual sources are not visible to an observer. Heavily diffusive elements are also used to mix the color spectra from the various sources to achieve a uniform output color profile. To blend the sources and aid in color mixing, heavily diffusive exit windows have been used. However, transmission through such heavily diffusive materials causes significant optical loss.

Some recent designs have incorporated an indirect lighting scheme in which the LEDs or other sources are aimed in a direction other than the intended emission direction. This may be done to encourage the light to interact with internal elements, such as diffusers, for example. One example of an indirect fixture can be found in U.S. Pat. No. 7,722,220 to Van de Ven which is commonly assigned with the present application.

Modern lighting applications often demand high power LEDs for increased brightness. High power LEDs can draw large currents, generating significant amounts of heat that must be managed. Many systems utilize heat sinks which must be in good thermal contact with the heat-generating light sources. Troffer-style fixtures generally dissipate heat from the back side of the fixture that extends into the plenum. This can present challenges as plenum space decreases in modern structures. Furthermore, the temperature in the plenum area is often several degrees warmer than the room environment below the ceiling, making it more difficult for the heat to escape into the plenum ambient.

SUMMARY OF THE INVENTION

A light engine unit according to an embodiment of the present invention comprises the following elements. An elongated heat sink comprises a mount surface. An elongated lens is mounted on the heat sink and over the mount surface. Reflectors extend from both sides of the heat sink away from the elongated lens. A lens plate is mounted proximate to the heat sink, with the lens plate extending away from the heat sink to the reflectors, such that the heat sink, the reflectors, and the lens plate at least partially define an interior cavity.

A lighting troffer according to an embodiment of the present invention comprises the following elements. An elongated heat sink comprises a mount surface. An elongated lens is mounted on the heat sink and over the mount surface. The elongated lens and the heat sink define an interior space. A plurality of light emitting diodes (LEDs) is disposed on the mount surface within the interior space. Reflectors extend from both sides of the heat sink away from the elongated lens. A lens plate is mounted proximate to the heat sink, with the lens plate extending away from the heat sink to the reflectors, such that the heat sink, the reflectors, and the lens plate at least partially define an interior cavity. A pan structure comprises an inner reflective surface. The inner reflective surface is disposed around the perimeter of the lens plate and extends away from the heat sink.

A light engine unit according to an embodiment of the present invention comprises the following elements. An elongated heat sink comprises a mount surface. An elongated lens is mounted on the heat sink and over the mount surface. At least one reflector extends from a side of the heat sink away from the elongated lens. A lens plate is mounted proximate to the heat sink. The lens plate extends away from the heat sink to the at least one reflector, such that the heat sink, the at least one reflector, and the lens plate at least partially define an interior cavity.

A lens according to an embodiment of the present invention comprises the following elements. An elongated body runs in a longitudinal direction, the body comprising at least one light entry surface, at least one front exit surface, and at least one side exit surface. The body is shaped to internally reflect light to exit out of the at least one side exit surface.

An elongated lighting unit according to an embodiment of the present invention comprises the following elements. A mount body comprises a mount surface. A plurality of light emitters is disposed on the mount surface. The light emitters are arranged in at least one cluster disposed along the length of said mount body.

BRIEF DESCRIPTION OF THE DRAWINGS

FIGS. 5*a-c* show a top plan view of portions of several light strips that may be used in light engine units according to embodiments of the present invention.

FIG. 8 is a bottom perspective view of a troffer according to an embodiment of the present invention.

DETAILED DESCRIPTION OF THE INVENTION

Figure 1:
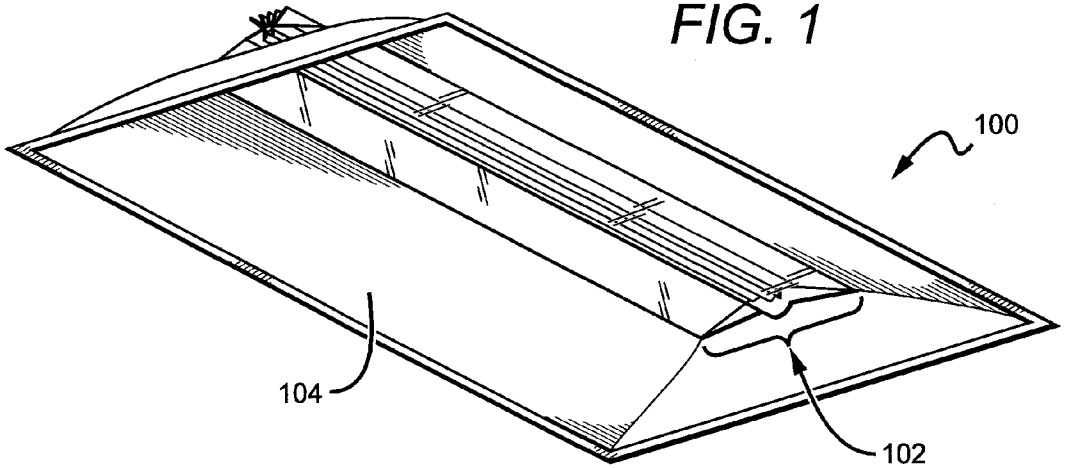
FIG. 1 is a perspective view from the bottom side of a troffer according to an embodiment of the present invention.

Embodiments of the present invention provide a troffer-style fixture that is particularly well-suited for use with solid state light sources, such as LEDs. The troffer comprises a light engine unit that is surrounded on its perimeter by a reflective pan. An elongated heat sink comprises a mount surface for light sources. An elongated lens is mounted on or above the heat sink such that an interior space is defined between the two elements. The space is designed to accommodate the light emitters which may come on prefabricated a light strip, for example. One or more reflectors extend out away from the heat sink on the mount surface side. A lens plate is mounted to proximate to the heat sink and extends out to the edge of the reflector(s). An interior cavity is at least partially defined by the reflector(s), the lens plates, and the heat sink. A portion of the heat sink is exposed to the ambient environment outside of the cavity. The portion of the heat sink inside the cavity functions as a mount surface for the light sources, creating an efficient thermal path from the sources to the ambient. One or more light sources disposed along the heat sink mount surface emit light into the interior cavity where it can be mixed and/or shaped before it is emitted from the troffer as useful light.

Because LED sources are relatively intense when compared to other light sources, they can create an uncomfortable working environment if not properly diffused. Fluorescent lamps using T8 bulbs typically have a surface luminance of around 21 $lm/in^2$. Many high output LED fixtures currently have a surface luminance of around 32 $lm/in^2$. Some embodiments of the present invention are designed to provide a surface luminance of not more than approximately 32 $lm/in^2$. Other embodiments are designed to provide a surface luminance of not more than approximately 21 $lm/in^2$. Still other embodiments are designed to provide a surface luminance of not more than approximately 12 $lm/in^2$.

Some fluorescent fixtures have a depth of 6 in., although in many modern applications the fixture depth has been reduced to around 5 in. In order to fit into a maximum number of existing ceiling designs, some embodiments of the present invention are designed to have a fixture depth of 5 in or less.

Embodiments of the present invention are designed to efficiently produce a visually pleasing output. Some embodiments are designed to emit with an efficacy of no less than approximately 65 lm/W. Other embodiments are designed to have a luminous efficacy of no less than approximately 76 lm/W. Still other embodiments are designed to have a luminous efficacy of no less than approximately 90 lm/W.

One embodiment of a recessed lay-in fixture for installation into a ceiling space of not less than approximately 4 $ft^2$ is designed to achieve at least 88% total optical efficiency with a maximum surface luminance of not more than 32 $lm/in^2$ with a maximum luminance gradient of not more than 5:1. Total optical efficiency is defined as the percentage of light emitted from the light source(s) that is actually emitted from the fixture. Other similar embodiments are designed to achieve a maximum surface luminance of not more than 24 $lm/in^2$. Still other similar embodiments are designed to achieve a maximum luminance gradient of not more than 3:1. In these embodiments, the actual room-side area profile of the fixture will be approximately 4 $ft^2$ or greater due to the fact that the fixture must fit inside a ceiling opening having an area of at least 4 $ft^2$ (e.g., a 2 ft by 2 ft opening, a 1 ft by 4 ft opening, etc.).

Embodiments of the present invention are described herein with reference to conversion materials, wavelength conversion materials, phosphors, phosphor layers and related terms. The use of these terms should not be construed as limiting. It is understood that the use of the term phosphor, or phosphor layers, is meant to encompass and be equally applicable to all wavelength conversion materials.

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relative spatial relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. For example, the term may be used to describe a single blue LED, or it may be used to describe a red LED and a green LED in proximity emitting as a single source. Thus, the term "source" should not be construed as a limitation indicating either a single-element or a multi-element configuration unless clearly stated otherwise.

The term "color" as used herein with reference to light is meant to describe light having a characteristic average wavelength; it is not meant to limit the light to a single wavelength. Thus, light of a particular color (e.g., green, red, blue, yellow, etc.) includes a range of wavelengths that are grouped around a particular average wavelength.

Embodiments of the invention are described herein with reference to cross-sectional view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the invention.

FIG. 1 is a perspective view from the bottom side of a troffer 100 according to an embodiment of the present invention. The troffer 100 comprises a light engine unit 102 which fits within a reflective pan 104 that surrounds the perimeter of the light engine 102. The light engine 102 and the pan 104 are discussed in detail herein. The troffer 100 may be suspended or fit-mounted within a ceiling. The view of the troffer 100 in FIG. 1 is from an area underneath the troffer 100, i.e., the area that would be lit by the light sources housed within the troffer 100.

The troffer 100 may be mounted in a ceiling such that the edge of the pan 104 is flush with the ceiling plane. In this configuration, the top portion of the troffer 100 would protrude into the plenum above the ceiling. The troffer 100 is designed to have a reduced height profile, so that the back end only extends a small distance (e.g., 4.25-5 in) into the plenum. In other embodiments, the troffer can extend larger distances into the plenum.

Figure 2:
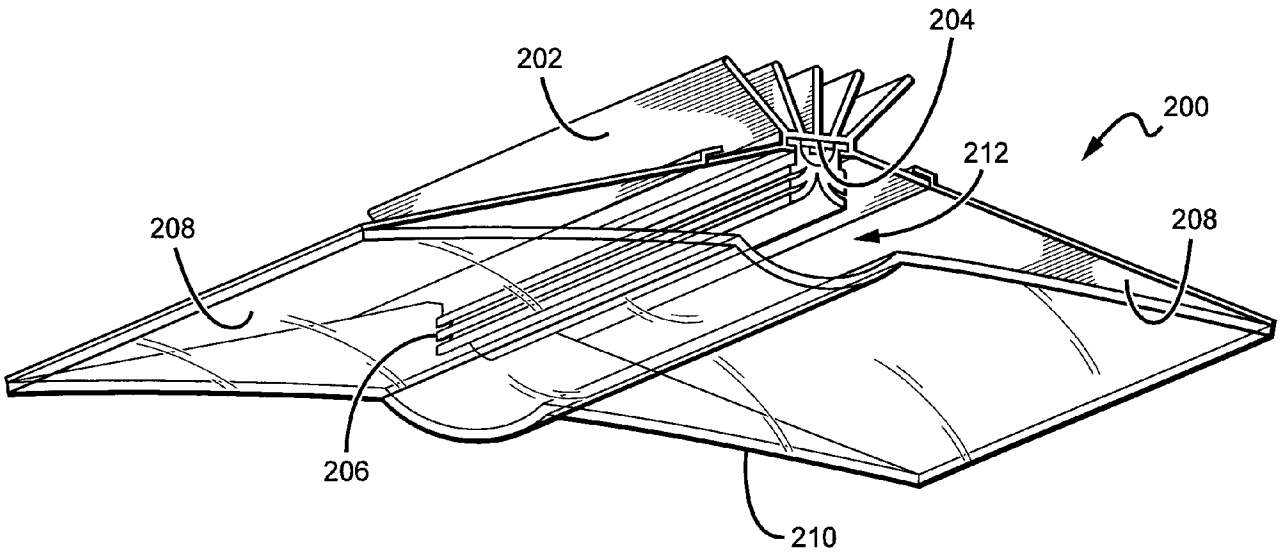
FIG. 2 is a perspective view of a light engine unit according to an embodiment of the present invention.

FIG. 2 is a perspective view of a light engine unit 200 according to an embodiment of the present invention. In this view, the light engine 200 is shown without the pan structure 104 shown in FIG. 1. Indeed, the light engine 200 is compatible with many different pan designs and can be mounted therein in several ways. An elongated heat sink 202 runs along the spine of the light engine 200. The heat sink 202 may comprise fins or other dissipative features on the side opposite the emission direction. The heat sink 202 also comprises a mount surface 204 for mounting light sources on the side facing the emission direction. An elongated lens 206 is disposed along the heat sink 202 over the mount surface 204. One or more reflectors 208 (two in this embodiment) extend out away from the heat sink 202, providing a reflective surface for emitted light. The reflectors 208 may be mounted to a laterally extended portion of the heat sink 202, as shown in FIG. 2, or, in other embodiments, the reflectors may be an integral with the heat sink structure. In either case, the reflectors 208 can provide additional surface area and a good thermal path from the source to the ambient. A lens plate 210 is mounted proximate to the heat sink 202 and extends out to meet the outer edges of the reflectors 208. The lens plate 210 may be mounted to the reflectors 208, as shown. In other embodiments, they may be mounted directly to the heat sink 208 or sandwiched in place between the heat sink and the pan structure. The heat sink 202, the reflectors 208, and the lens plate 210 define an interior cavity 212 where the emitted light may be mixed, wavelength converted, or otherwise controlled, prior to being emitted as useful light.

Figure 3:
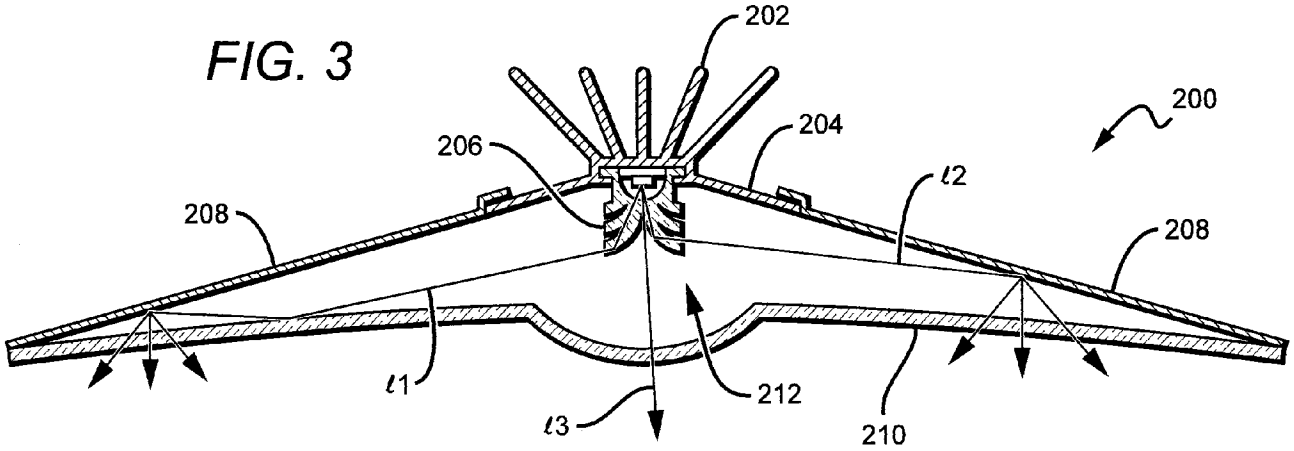
FIG. 3 is a cross-sectional view of a light engine unit according to an embodiment of the present invention.

FIG. 3 is a cross-sectional view of the light engine unit 200. The heat sink 202 is mounted proximate to the reflectors 208. The mount surface 204 provides a substantially flat area where light sources (shown in more detail below) can be mounted to face in a direction normal to the ceiling plane, although the light sources could be angled in other off-axis directions. In this embodiment, the reflectors 208 extend from both sides of the heat sink 202 to the top edge of the lens plate. In some embodiments, the light sources may be mounted to a separate strip, such as a metal core board, FR4 board, printed circuit board, or a metal strip, such as aluminum, which can then be inserted into the space between the heat sink 202 and the elongated lens 206. The strip may then be mounted to the mount surface 204, using thermal paste, adhesive, and/or screws, for example.

With continued reference to FIGS. 2 and 3, the reflectors 208 may be designed to have several different shapes to perform particular optical functions, such as color mixing and beam shaping, for example. The reflector 208 should be highly reflective in the wavelength ranges of the light sources. In some embodiments, the back reflectors 208 may be 93% reflective or higher. In other embodiments, the reflectors 208 may be at least 95% reflective or at least 97% reflective.

The reflectors 208 may comprise many different materials. For many indoor lighting applications, it is desirable to present a uniform, soft light source without unpleasant glare, color striping, or hot spots. Thus, the reflectors 208 may comprise a diffuse white reflector such as a microcellular polyethylene terephthalate (MCPET) material or a Dupont/WhiteOptics material, for example. Other white diffuse reflective materials can also be used.

Diffuse reflective coatings have the inherent capability to mix light from solid state light sources having different spectra (i.e., different colors). These coatings are particularly well-suited for multi-source designs where two different spectra are mixed to produce a desired output color point. For example, LEDs emitting blue light may be used in combination with LEDs emitting yellow (or blue-shifted yellow) light to yield a white light output. A diffuse reflective coating may eliminate the need for additional spatial color-mixing schemes that can introduce lossy elements into the system; although, in some embodiments it may be desirable to use diffuse reflectors in combination with other diffusive elements. In some embodiments, the reflectors are coated with a phosphor material that converts the wavelength of at least some of the light from the light emitting diodes to achieve a light output of the desired color point.

By using a diffuse white reflective material for the reflector 208 several design goals are achieved. For example, the reflectors 208 perform a color-mixing function, effectively doubling the mixing distance and greatly increasing the surface area of the source. Additionally, the surface luminance is modified from bright, uncomfortable point sources to a much larger, softer diffuse reflection. A diffuse white material also provides a uniform luminous appearance in the output. Harsh surface luminance gradients (max/min ratios of 10:1 or greater) that would typically require significant effort and heavy diffusers to ameliorate in a traditional direct view optic can be managed with much less aggressive (and lower light loss) diffusers achieving max/min ratios of 5:1, 3:1, or even 2:1.

The reflectors 208 can comprise materials other than diffuse reflectors. In some embodiments, the reflectors 208 can comprise a specular reflective material or a material that is partially diffuse reflective and partially specular reflective. In other embodiments, it may be desirable to use a specular material in one area and a diffuse material in another area. For example, a semi-specular material may be used in regions closer to the heat sink with a diffuse material used in distal regions to give a more directional reflection to the sides. Many combinations are possible.

The reflectors 208 provide a linear interior reflective surface. It is understood that these interior surfaces may be curved or curvilinear to achieve a particular output profile.

In this particular embodiment, the lens plate 210 comprises three distinct regions: a convex center region and two concave regions on either side. Three exemplary light rays are shown in FIG. 3. Light ray $l_1$ is emitted from a source and internally redirected by the elongated lens 206 (best shown in FIG. 4) away from its natural path but not far enough to directly impact the reflector 208. The concave surface of the side region of the reflector 208 provides a grazing bounce that allows the light to reach the farthest edge of the lens plate 210. Light ray $l_2$ is also redirected by the elongated lens 206, but the exit angle is more drastic and the light directly impinges the reflector 208 directly. In the center, light ray $l_3$ is not redirected out the side of the elongated lens; instead, it is emitted toward the convex center region of the lens plate 210. The convex shape of the center region of the lens plate provides a greater mixing distance, improving the color uniformity and minimizing the contrast of the output profile. In other embodiments, the shape of the lens plate may be altered to achieve a desired output profile. Many other shapes are possible.

The lens plate 210 can comprise many different elements and materials. In one embodiment, the lens plate 210 comprises a diffusive element. A diffusive lens plate functions in several ways. For example, it can prevent direct visibility of the sources and provide additional mixing of the outgoing light to achieve a visually pleasing uniform source. However, a diffusive lens plate can introduce additional optical loss into the system. Thus, in embodiments where the light is sufficiently mixed by the reflector or by other elements, a diffusive lens plate may be unnecessary. In such embodiments, a transparent glass or thermoplastic lens plate may be used. In still other embodiments, scattering particles may be included in the lens plate 210.

Diffusive elements in the lens plate 210 can be achieved with several different structures. A diffusive film inlay can be applied to the top- or bottom-side surface of the lens plate 210. It is also possible to manufacture the lens plate 210 to include an integral diffusive layer, such as by coextruding the two materials or insert molding the diffuser onto the exterior or interior surface. A clear lens may include a diffractive or repeated geometric pattern rolled into an extrusion or molded into the surface at the time of manufacture. In another embodiment, the lens plate material itself may comprise a volumetric diffuser, such as an added colorant or particles having a different index of refraction, for example.

In other embodiments, the lens plate may be used to optically shape the outgoing beam with the use of microlens structures, for example. Many different kinds of beam shaping optical features can be included integrally with various lens plates.

Figure 4:
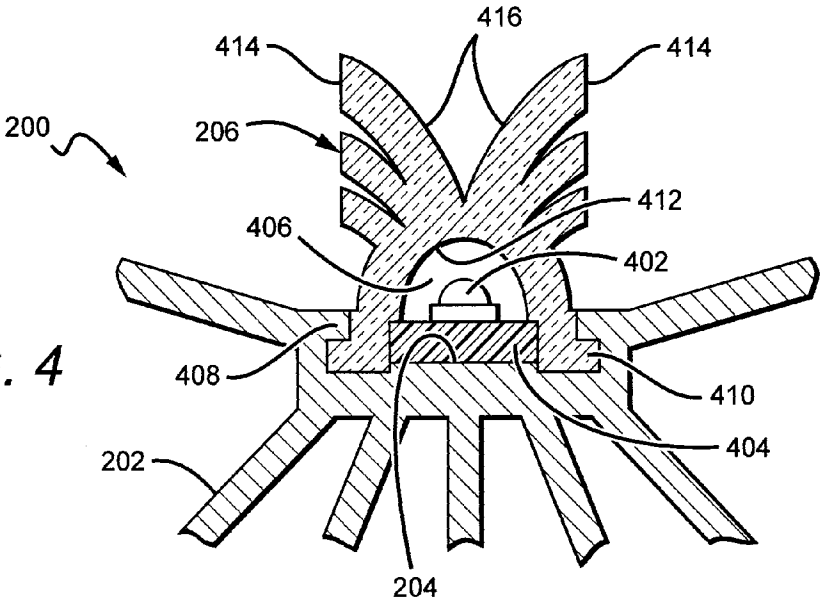
FIG. 4 is a close-up cross-sectional view of a portion of a light engine unit according to an embodiment of the present invention.

FIG. 4 is a close-up cross-sectional view of a portion of the light engine unit 200. One or more light sources 402 are disposed on the mount surface 204. In this embodiment the light source 402 is on a PCB 404 which can be slid into the interior space 406 between the heat sink 202 and the elongated lens 206. The heat sink 202 comprises notches 408 that are designed to mate with flanges 410 on the elongated lens 206. When mated with the heat sink 202, the elongated lens 206 provides a compressive force against the PCB 404 to enable good thermal transfer from the source 402 to the heat sink 202. The ability to simply slide the PCB 404 (perhaps aided by thermal grease) into the interior space 406 provides a low labor, cost-effective method for attaching the PCB 404 and the elongated lens 206 to the heat sink 202. The elongated lens 206 may be attached to the heat sink by other means, for example, a snap-fit structure.

In this embodiment, the elongated lens 206 is symmetrical about a bisecting plane normal to the mount surface 204. The lens 206 is designed to function as a total internal reflection (TIR) optic wherein incident light enters a light entry surface 412 with a portion of the light internally redirected such that it exits side surfaces 414. Another portion of the light exits a front surface 416 of the lens 206. In some embodiments of the lens, at least 70% of the light that enters the lens exits through side surfaces. In other embodiments, at least 80% exits side surfaces of the lens. In still other embodiments, at least 90% exits side surfaces of the lens. The lens 206 helps to spread the light from the source 402 out across the entire surface of lens plate 210. Many different shapes may be used for the elongated lens to achieve a particular output profile. The elongated lens 206 may be manufactured by extrusion, for example. In some embodiments, it may be desirable to add features along the longitudinal direction of the lens 206. In this case the lens 206 may be fabricated by rolling a repeated pattern into the extrusion or by using an injection mold process.

The elongated lens 206 may be shaped in several ways and may be fabricated in many different sizes to fit a particular application. In one embodiment, the lens may have an aspect ratio (length to width) as small as approximately 10:1, for example, 10 in. long by 1 in. wide. In other embodiments that lens may have an aspect ratio as large as approximately 80:1, for example, 40 in. long by 0.5 in. wide. It is understood that other aspect ratios and dimensions are possible.

The mount surface 204 provides a substantially flat area on which one or more light sources can be mounted. In some embodiments, the light source(s) will be pre-mounted on light strips, such as PCB 404. FIGS. 5*a-c* show a top plan view of portions of several light strips 500, 520, 540 that may be used to mount multiple LEDs to the mount surface 204. Although LEDs are used as the light sources in various embodiments described herein, it is understood that other light sources, such as laser diodes for example, may be substituted in as the light sources in other embodiments of the invention.

Many industrial, commercial, and residential applications call for white light sources. The light engine 200 may comprise one or more emitters producing the same color of light or different colors of light. In one embodiment, a multicolor source is used to produce white light. Several colored light combinations will yield white light. For example, as discussed in U.S. Pat. Nos. 7,213,940 and 7,768,192, both of which are assigned to Cree, Inc., and both of which are incorporated herein by reference, it is known in the art to combine light from a blue LED with wavelength-converted yellow light to yield white light with correlated color temperature (CCT) in the range between 5000K to 7000K (often designated as "cool white"). Both blue and yellow light can be generated with a blue emitter by surrounding the emitter with phosphors that are optically responsive to the blue light. When excited, the phosphors emit yellow light which then combines with the blue light to make white. In this scheme, because the blue light is emitted in a narrow spectral range it is called saturated light. The yellow light is emitted in a much broader spectral range and, thus, is called unsaturated light.

Another example of generating white light with a multicolor source is combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several of these possible color combinations are discussed in detail in U.S. Pat. No. 7,213,940 to Van de Ven et al.

Elongated lighting units include the lighting strips 500, 520, 540 each of which represent possible LED combinations that result in an output spectrum that can be mixed to generate white light. Each lighting strip can include the electronics and interconnections necessary to power the LEDs. In some embodiments the lighting strip comprises a printed circuit board with the LEDs mounted and interconnected thereon. The lighting strip 500 includes clusters 502 of discrete LEDs, with each LED within the cluster 502 spaced a distance from the next LED, and each cluster 502 spaced a distance from the next cluster. If the LEDs within a cluster are spaced at too great distance from one another, the colors of the individual sources may become visible, causing unwanted color-striping. In some embodiments, an acceptable range of distances for separating consecutive LEDs within a cluster is not more than approximately 8 mm.

The scheme shown in FIG. 5*a* uses a series of clusters 502 having two blue-shifted-yellow LEDs ("BSY") and a single red LED ("R"). BSY refers to a color created when blue LED light is wavelength-converted by a yellow phosphor. The resulting output is a yellow-green color that lies off the black body curve. BSY and red light, when properly mixed, combine to yield light having a "warm white" appearance. These and other color combinations are described in detail in the previously incorporated patents to Van de Ven (U.S. Pat. Nos. 7,213,940 and 7,768,192).

The lighting strip 520 includes clusters 522 of discrete LEDs. The scheme shown in FIG. 5*b* uses a series of clusters 522 having three BSY LEDs and a single red LED. This scheme will also yield a warm white output when sufficiently mixed.

The lighting strip 540 includes clusters 542 of discrete LEDs. The scheme shown in FIG. 5*c* uses a series of clusters 542 having two BSY LEDs and two red LEDs. This scheme will also yield a warm white output when sufficiently mixed.

The lighting schemes shown in FIGS. 5*a-c* are meant to be exemplary. Thus, it is understood that many different LED combinations can be used in concert with known conversion techniques to generate a desired output light color.

Because lighting fixtures are traditionally used in large areas populated with modular furniture, such as in an office for example, many fixtures can be seen from anywhere in the room. Specification grade fixtures often include mechanical shielding in order to effectively hide the light source from the observer once he is a certain distance from the fixture, providing a "quiet ceiling" for a more comfortable work environment.

Because human eyes are sensitive to light contrast, it is generally desirable to provide a gradual reveal of the brightness from the troffer 100 as an individual walks through a lighted room. One way to ensure a gradual reveal is to use the surfaces of the troffer 100 to provide mechanical cutoff.

Figure 6:
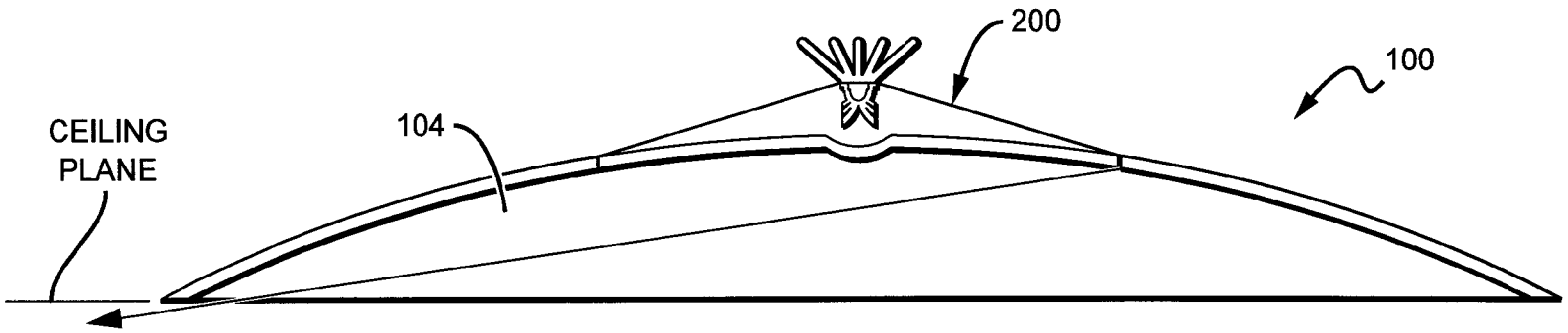
FIG. 6 is cross-sectional view of a troffer according to an embodiment of the present invention.

FIG. 6 is cross-sectional view of the troffer 100. In this embodiment, the pan structure occludes the light engine 200 low viewing angles. Using these surfaces, the mechanical structure of the troffer 100 provides built-in glare control. In the troffer 100, the primary cutoff is 8° due to the edge of the pan 104.

Figure 7:
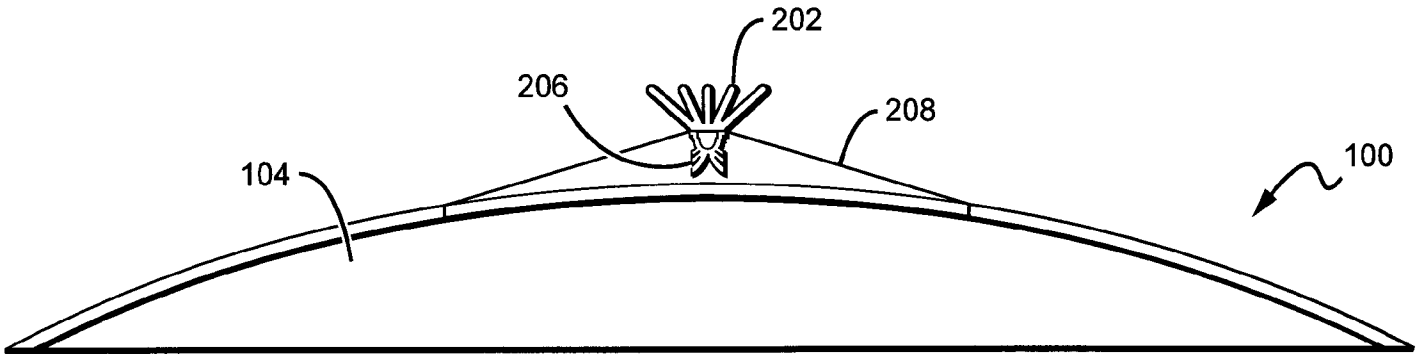
FIG. 7 is a side plan view of a troffer according to an embodiment of the present invention.

FIG. 7 is a side plan view of the troffer 100. This particular embodiment does not include end caps. Thus, the elongated lens 206 is visible, but the lens plate 210 is occluded by the pan structure 104. Some embodiments may include reflective endcaps designed to reflect the light back into the interior cavity 212. Other embodiments use transmissive endcaps to transmit a portion of the light out the ends. Transmissive end caps allow light to pass from the ends of the cavity to the end of the pan structure 104. Because light passes through them, the end caps help to reduce the shadows that are cast on the pan 104 when the light sources are operational. Endcaps having many different shapes and made from many different materials are possible.

Troffers according to embodiments of the present invention can have many different sizes and aspect ratios. FIG. 8 is a bottom perspective view of a troffer 800 according to an embodiment of the present invention. This particular troffer 800 has an aspect ratio (length to width) of 1:1. That is, the length and the width of the troffer 800 are the same, in this case 2 ft×2 ft. The troffer 100 (as shown in FIG. 1) has an aspect ratio of 2:1, or 2 ft×4 ft. In another embodiment, the troffer has an aspect ratio of 1:2 with dimensions of 1 ft by 4 ft, for example. It is understood that other dimensions are possible.

Figure 9:
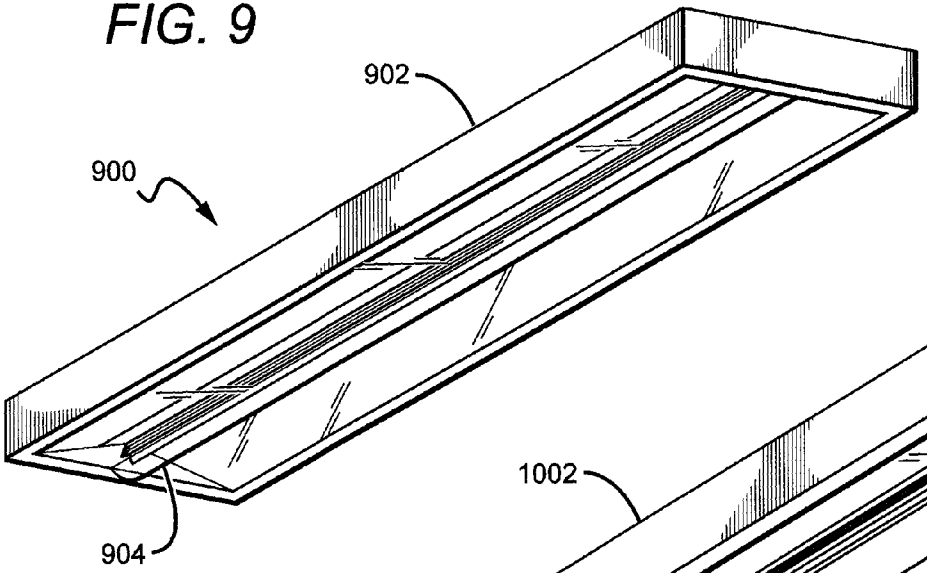
FIG. 9 is a bottom perspective view of a lighting fixture according to an embodiment of the present invention.

FIG. 9 is a bottom perspective view of a lighting fixture 900 according to an embodiment of the present invention. The fixture 900 comprises a rectangular frame 902 that surrounds the light engine 904. In this embodiment, the light engine 900 is mounted flush with the bottom of the frame 902. Thus, the frame 900 does not significantly affect the characteristics of the output profile. The fixture 900 can function as a continuous strip surface-type fixture.

Figure 10:
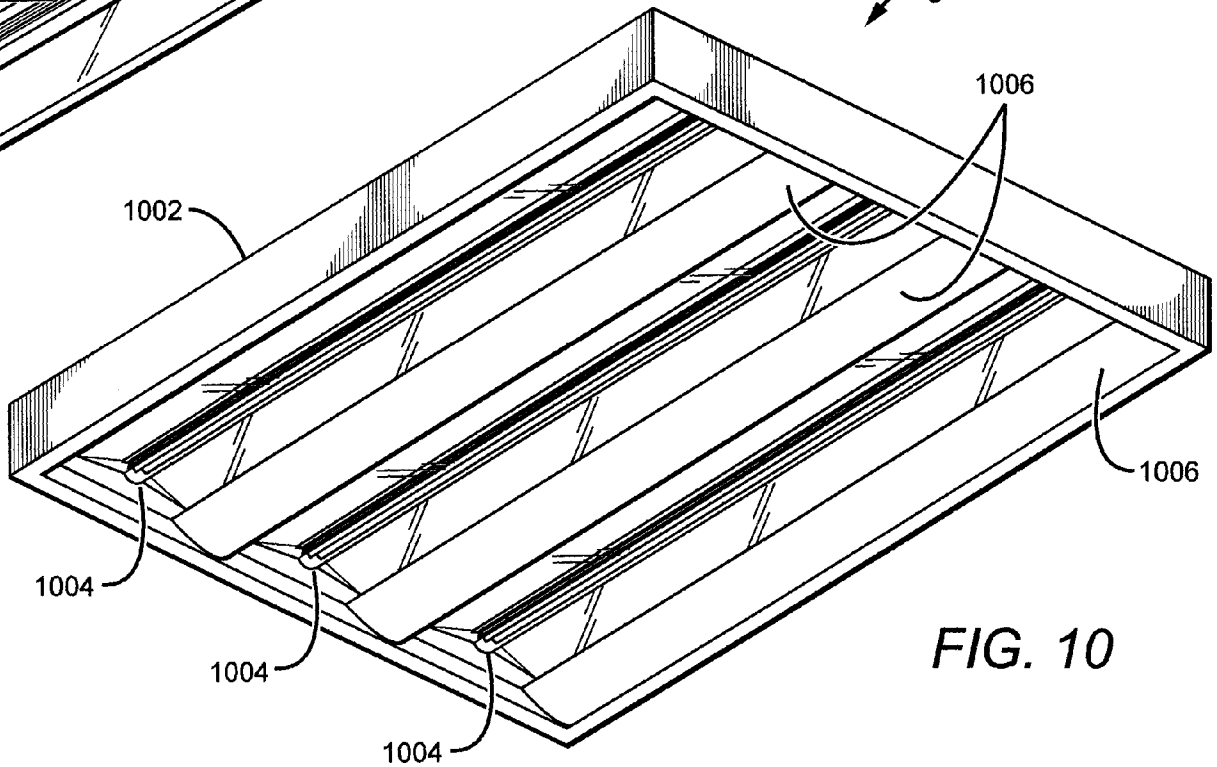
FIG. 10 is a bottom perspective view of a lighting fixture according to an embodiment of the present invention.

FIG. 10 shows a bottom perspective view of another lighting fixture according to an embodiment of the present invention. The fixture 1000 comprises a frame 1002 surrounding three light engine units 1004 which are arranged parallel to one another. This embodiment includes parabolic specular reflectors 1006 at the side ends of the frame 1002 and in between the light engines 1004. The reflectors 1006 direct more of the light toward the area directly beneath the fixture than would be accomplished with the light engine optics alone. The fixture 1000 may be characterized as a high bay fixture.

It is understood that embodiments presented herein are meant to be exemplary. Embodiments of the present invention can comprise any combination of compatible features shown in the various figures, and these embodiments should not be limited to those expressly illustrated and discussed.

Although the present invention has been described in detail with reference to certain preferred configurations thereof, other versions are possible. Therefore, the spirit and scope of the invention should not be limited to the versions described above.

I claim:

1. A light engine unit, comprising:

an elongated heat sink comprising a mount surface;

an elongated lens on said heat sink and over said mount surface;

reflectors extending from both sides of said heat sink away from said elongated lens; and a light transmissive lens plate proximate to said heat sink, said light transmissive lens plate spaced apart from said heat sink and proximate to said reflectors, such that said heat sink, said reflectors, and said light transmissive lens plate at least partially define an interior cavity, wherein said elongated lens is at least partially within said interior cavity;

wherein said elongated lens is at least partially between said heat sink and said light transmissive lens plate.

2. The light engine unit of claim 1, further comprising at least one light source on said mount surface such that said at least one light source is at least partially surrounded by said elongated lens.

3. The light engine unit of claim 2, said at least one source comprising at least one cluster of light emitting diodes (LEDs).

4. The light engine unit of claim 2, said at least one source comprising at least one cluster of LEDs comprising two blue-shifted yellow LEDs and a red LED.

5. The light engine unit of claim 2, said at least one source comprising at least one cluster of LEDs comprising three blue-shifted yellow LEDs and a red LED.

6. The light engine unit of claim 2, said at least one source comprising at least one cluster of LEDs comprising a blue-shifted yellow LED and a red LED.

7. The light engine unit of claim 2, said at least one source comprising at least one cluster of LEDs comprising two blue-shifted yellow LEDs and two red LEDs.

8. The light engine unit of claim 1, further comprising at least one light strip on said mount surface such that said at least one light strip faces said elongated lens.

9. The light engine unit of claim 8, wherein said light strip comprises a printed circuit board (PCB) and a plurality of LEDs thereon.

10. The light engine unit of claim 1, said elongated lens shaped to accept light from the side facing said heat sink and redirect at least some of said light out of either side of said elongated lens.

11. The light engine unit of claim 1, said reflectors comprising a diffuse white reflector.

12. The light engine unit of claim 1, said reflectors comprising a microcellular polyethylene terephthalate (MC-PET) material.

13. The light engine unit of claim 1, said reflectors comprising a specular reflective material.

14. The light engine unit of claim 1, wherein said reflectors are partially specular reflective and partially diffuse reflective.

15. The light engine unit of claim 1, wherein said reflectors are greater than 97% reflective.

16. The light engine unit of claim 1, wherein said reflectors are greater than 95% reflective.

17. The light engine unit of claim 1, wherein said reflectors are greater than 93% reflective.

18. The light engine unit of claim 1, said light transmissive lens plate comprising an elongated center region and two side regions, said center region running along the same direction as said elongated heat sink.

19. The light engine unit of claim 18, said center region comprising a convex shape defined from a reference point outside said interior cavity, said side regions comprising a concave shape.

20. The light engine unit of claim 1, said light transmissive lens plate comprising a diffusive film inlay.

21. The light engine unit of claim 1, said light transmissive lens plate comprising a diffusive film integral to said light transmissive lens plates.

22. The light engine unit of claim 1, said light transmissive lens plate comprising a diffractive pattern.

23. The light engine unit of claim 1, said light transmissive lens plate comprising a random or regular geometric pattern.

24. The light engine unit of claim 1, said light transmissive lens plate comprising a diffusive volumetric material.

25. The light engine unit of claim 1, said light transmissive lens plate comprising beam-shaping features.

26. The light engine unit of claim 1, said light transmissive lens plate comprising microlens structures.

27. The light engine unit of claim 1, further comprising transmissive end caps at both longitudinal ends of said light engine unit.

28. The light engine unit of claim 1, said heat sink comprising notches and said elongated lens comprising flanges shaped to mate with said notches such that said elongated lens may be held in place over said mount surface.

29. The light engine unit of claim 1, wherein said elongated lens is mounted to said heat sink with a snap-fit structure.

30. The light engine unit of claim 1, wherein said heat sink and said elongated lens define an interior space over said mount surface wherein a light strip can be inserted.

31. A lighting troffer, comprising:

an elongated heat sink comprising a mount surface;

an elongated lens on said heat sink and over said mount surface, said elongated lens and said heat sink defining an interior space;

a plurality of light emitting diodes (LEDs) on said mount surface within said interior space;

reflectors extending from both sides of said heat sink away from said elongated lens;

a lens plate proximate to said heat sink, said lens plate spaced apart from said heat sink and proximate to said reflectors, such that said heat sink, said reflectors, and said lens plate at least partially define an interior cavity, wherein said elongated lens is at least partially within said interior cavity, wherein at least some light from said plurality of LEDs is transmitted through said lens plate when said LEDs are operational; and a pan structure comprising an inner reflective surface, said inner reflective surface around the perimeter of said lens plate and extending away from said heat sink.

32. The lighting troffer of claim 31, wherein said plurality of LEDs are on a printed circuit board (PCB) that is on said mount surface.

33. The lighting troffer of claim 31, wherein said plurality of LEDs is in at least one cluster along said mount surface.

34. The lighting troffer of claim 31, wherein light emitted from said LEDs is mixed such that the light emitting from said lighting troffer appears white.

35. The lighting troffer of claim 31, said elongated lens shaped to accept light from the side facing said heat sink and redirect at least some of said light out of either side of said elongated lens.

36. The lighting troffer of claim 31, said reflectors comprising a diffuse white reflector.

37. The lighting troffer of claim 31, said reflectors comprising a specular reflective material.

38. The lighting troffer of claim 31, wherein said reflectors are partially specular reflective and partially diffuse reflective.

39. The lighting troffer of claim 31, said lens plate comprising an elongated center region and two side regions with said center region running along the same direction as said elongated heat sink.

40. The lighting troffer of claim 39, said center region comprising a convex shape defined from a reference point outside said interior cavity, said side regions comprising a concave shape.

41. The lighting troffer of claim 31, said lens plate comprising a diffusive film inlay.

42. The lighting troffer of claim 31, said lens plate comprising a diffusive film integral to said lens plates.

43. The lighting troffer of claim 31, said lens plate comprising a diffractive pattern.

44. The lighting troffer of claim 31, said lens plate comprising a random or regular geometric pattern.

45. The lighting troffer of claim 31, said lens plate comprising a diffusive volumetric material.

46. The lighting troffer of claim 31, said lens plate comprising beam-shaping features.

47. The lighting troffer of claim 31, said lens plate comprising microlens structures.

48. The lighting troffer of claim 31, further comprising transmissive end caps at both longitudinal ends of said light engine unit.

49. The lighting troffer of claim 31, said heat sink comprising notches and said elongated lens comprising flanges shaped to mate with said notches such that said elongated lens may be held in place over said mount surface.

50. The lighting troffer of claim 31, wherein said elongated lens is mounted to said heat sink with a snap-fit structure.

51. The lighting troffer of claim 31, wherein said heat sink and said elongated lens define an interior space over said mount surface wherein a light strip can be inserted.

52. A light engine unit, comprising:

an elongated heat sink comprising a mount surface;

an elongated lens on said heat sink and over said mount surface;

at least one reflector extending from a side of said heat sink away from said elongated lens; and a lens plate proximate to said heat sink, said lens plate spaced apart from said heat sink and proximate to said at least one reflector, such that said heat sink, said at least one reflector, and said lens plate at least partially define an interior cavity, wherein said elongated lens is at least partially within said interior cavity, wherein at least some light emitted within said interior cavity is emitted out through said lens plate.

53. The light engine unit of claim 52, wherein said mount surface of said heat sink faces at an angle toward the intersection of said at least one reflector and said lens plate.

54. The light engine unit of claim 52, said reflector comprising a diffuse white reflector.

55. The light engine unit of claim 52, wherein said light engine unit is asymmetrical about a longitudinal axis running through said heat sink.

56. A lens, comprising:

an elongated body, said body comprising at least one light entry surface, at least one front exit surface, and at least one side exit surface, wherein said body is shaped to internally reflect at least some light, such that said at least some light exits out of said at least one side exit surface over a range of different exit angles.

57. The lens of claim 56, wherein said body is shaped to redirect at least 70% of light entering said light entry surface out of said at least one side exit surface and at least a portion of the remaining light out of said at least one front exit surface.

58. The lens of claim 56, wherein said body is shaped to redirect at least 80% of light entering said light entry surface out of said at least one side exit surface and at least a portion of the remaining light out of said at least one front exit surface.

59. The lens of claim 56, wherein said body is shaped to redirect at least 90% of light entering said light entry surface out of said at least one side exit surface and at least a portion of the remaining light out of said at least one front exit surface.

60. The lens of claim 56, further comprising a mount mechanism.

61. The lens of claim 56, further comprising flanges shaped to provide a mount mechanism.

62. The lens of claim 56, said lens comprising an aspect ratio (length to width) of no less than approximately 10:1.

63. The lens of claim 56, said lens comprising an aspect ratio (length to width) of no more than approximately 80:1.

64. An elongated lighting unit, comprising:

a mount body comprising a mount surface;

a plurality of light sources on said mount surface, at least one of said light sources comprising a phosphor material;

a lens on said mount body; and a lens plate proximate to said mount body, wherein at least some light from said plurality of light sources passes through said lens plate;

wherein said light sources are in a plurality of clusters along the length of said mount body;

wherein each of said light sources within one of said clusters is separated by at least a first longitudinal distance;

wherein each of said clusters is separated by at least a second longitudinal distance larger than said first distance.

65. The elongated lighting unit of claim 64, said mount body comprising a printed circuit board (PCB).

66. The elongated lighting unit of claim 64, at least one of said clusters comprising two blue-shifted yellow light emitting diodes (LEDs) and a red LED.

67. The elongated lighting unit of claim 64, at least one of said clusters comprising three blue-shifted yellow LEDs and a red LED.

68. The elongated lighting unit of claim 64, at least one of said clusters comprising a blue-shifted yellow LED and a red LED.

69. The elongated lighting unit of claim 64, at least one of said clusters comprising two blue-shifted yellow LEDs and two red LEDs.

70. The elongated lighting unit of claim 64, said mount body further comprising electronic components and interconnections for operating said plurality of light emitters.

71. The elongated lighting unit of claim 64, wherein each of said clusters comprises at least one phosphor-based light emitter.

72. The elongated lighting unit of claim 64, wherein a longitudinal distance between consecutive sources within each of said clusters is uniform.

73. The elongated lighting unit of claim 64, wherein said longitudinal distance between consecutive light clusters is not more than approximately 8 mm.

74. The light engine unit of claim 2, wherein emission from said at least one light source is substantially in the same direction as the intended emission of the light engine unit.

75. The light engine unit of claim 2, wherein said at least one light source is positioned to emit at least some light in an initial direction toward an exit surface of said light engine unit.

* * * * *